US006701888B2

(12) United States Patent
Houtz

(10) Patent No.: US 6,701,888 B2
(45) Date of Patent: Mar. 9, 2004

(54) COMPRESSION BRAKE SYSTEM FOR AN INTERNAL COMBUSTION ENGINE

(75) Inventor: Philip J. Houtz, Lafayette, IN (US)

(73) Assignee: Caterpillar Inc, Peoria, IL (US)

( * ) Notice: Subject to any disclaimer, the term of this patent is extended or adjusted under 35 U.S.C. 154(b) by 203 days.

(21) Appl. No.: 09/996,844

(22) Filed: Nov. 29, 2001

(65) Prior Publication Data

US 2002/0108600 A1 Aug. 15, 2002

Related U.S. Application Data

(60) Provisional application No. 60/250,481, filed on Dec. 1, 2000.

(51) Int. Cl.[7] ..... F02D 13/04
(52) U.S. Cl. ..... 123/321; 123/90.12
(58) Field of Search ..... 123/320, 321, 123/90.12, 90.15, 90.16

(56) References Cited

U.S. PATENT DOCUMENTS 4,150,640 A 4/1979 Egan
4,930,464 A * 6/1990 Letsche ..... 123/90.12
5,462,025 A * 10/1995 Israel et al. ..... 123/321
5,526,784 A 6/1996 Hakkenberg et al.
5,765,515 A * 6/1998 Letsche ..... 123/90.12

* cited by examiner

*Primary Examiner*—Mahmoud Gimie
(74) *Attorney, Agent, or Firm*—Keith P. Roberson; Stephen L. Noe

(57) ABSTRACT

Improving compression brake systems (10) require better control of timing an actuation event. Numerous systems use complicated electronic controls to achieve such control. Cam actuated compression brake systems may reduce braking power by allowing a valve 32 on an internal combustion engine (30) to remain open well after an optimum crank angle. Using a by-pass port (42), pressure may be increased in a second actuator volume (22) opposite a first actuator volume (20). Increasing pressures in the second actuator volume (22) promotes closing the valve (26) near the optimum crank angle.

13 Claims, 2 Drawing Sheets

COMPRESSION BRAKE SYSTEM FOR AN INTERNAL COMBUSTION ENGINE

This application claims the benefit of provisional application No. 60/250,481 filed on Dec. 1, 2000.

TECHNICAL FIELD

This invention relates generally to an internal combustion engine and more particularly to operation of engine valves to facilitate engine braking or compression braking.

BACKGROUND

Compression brakes are well know devices in the industry used to provide additional stopping force especially in large vehicles. In a standard four-cycle operation during a combustion stroke, an exhaust valve is generally in a closed position from near bottom dead center (BDC) to top dead center (TDC) and back to BDC. During a compression brake operation during the combustion stroke, the exhaust valve generally opens as a piston moves from BDC to TDC and closes as the piston moves from TDC to BDC.

One manner of controlling operation of the exhaust valve during a brake operation involves using a master piston and a slave piston. As shown in U.S. Pat. No. 4,150,640 issued to Egan on Apr. 24, 1979, the master piston operates in response to movement of a fuel injection cam. Fixing brake actuation to the fuel injection cam may tend to maintain the exhaust valve open for an extended period after the piston reaches TDC.

Other systems have added more complicated actuation mechanisms to provide control with less ties to a fixed cam lobe. U.S. Pat. No. 5,526,784 issued to Hakkenbert et al on Jun. 18, 1996 uses electronically controlled hydraulic actuation to control operation of the exhaust valve. These systems provide greater control over brake actuation. Cost and complexity may prevent implementation of these systems in some applications.

The present invention is directed to overcoming one or more of the problems as set forth above.

SUMMARY OF THE INVENTION

In one aspect of the present invention a compression brake system for an internal combustion engine has a master cylinder and a master piston slidably positioned therein. A brake actuator cylinder connects with the master cylinder. A brake actuator piston positioned in the brake actuator cylinder actuates a valve. In a first position, the brake actuator piston limits fluid communication between the master cylinder and a second actuator volume. In a second position, the brake actuator piston allows fluid communication between the master cylinder and the second actuator volume.

DETAILED DESCRIPTION

Figure 1:
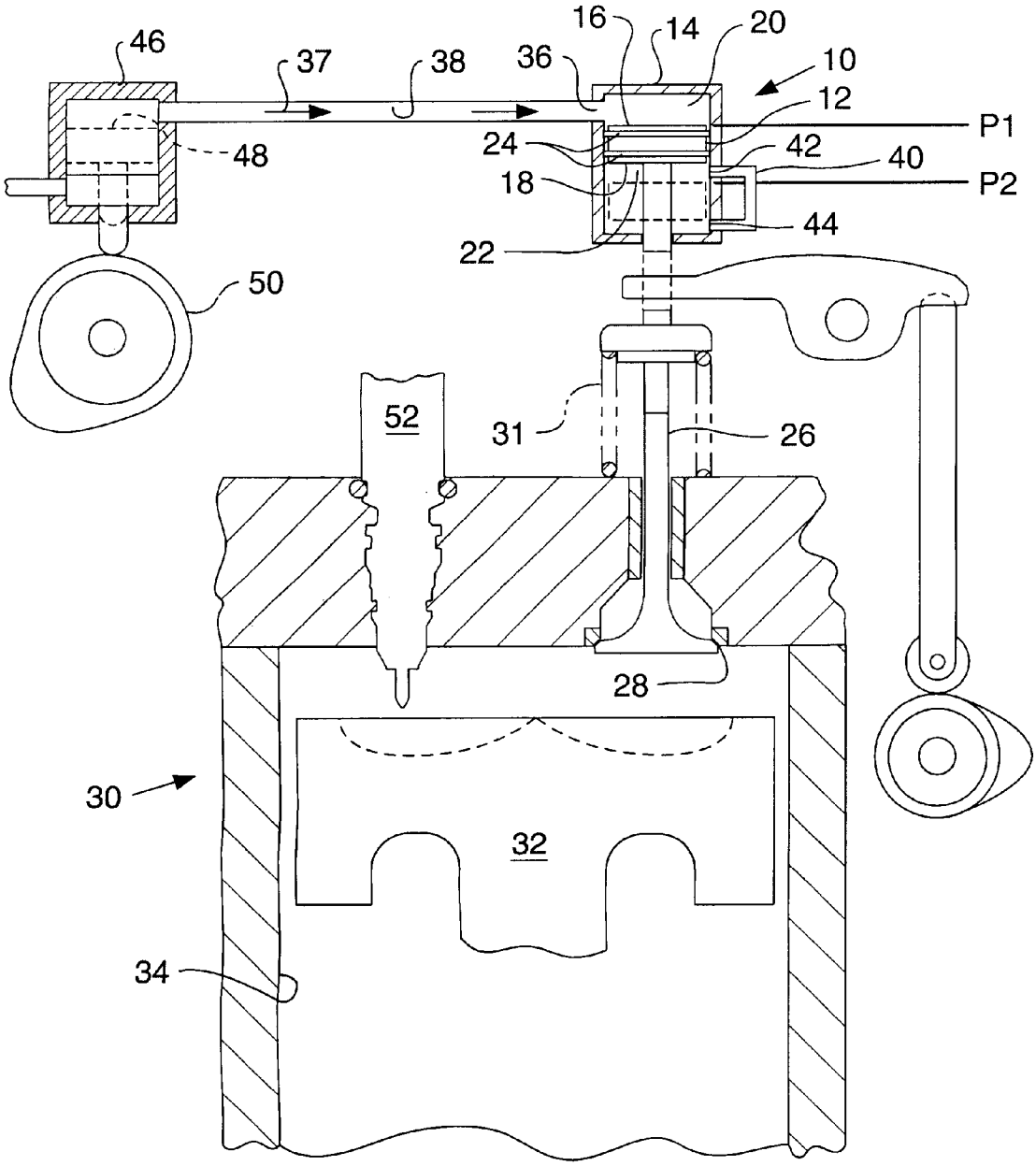
FIG. 1 shows an internal combustion having an embodiment of the present invention.

In FIG. 1 a compression brake system 10 has a brake actuator piston 12 and a brake actuator cylinder 14. The brake actuator piston 12 is slidably positioned in the actuator cylinder 14. The brake actuator piston 12 has a first actuating surface 16 and a second actuating surface 18 opposite one another. The first actuating surface 16 and brake actuator cylinder 14 define a first actuator volume 20. The second actuating surface 18 and brake actuator cylinder define a second actuator volume 22. A seal 24 of any conventional design connects between the brake actuator piston 12 and the actuator cylinder 14.

The brake actuator piston 12 connects with a valve 26 positioned in a port 28 of an internal combustion engine 30. In this application the valve 26 is an exhaust valve positioned in an exhaust port. A valve spring 31 connects between the engine 30 and valve 26. The engine 30 may be of any conventional design having a piston 32 moving within a combustion cylinder 34.

The brake actuator cylinder 14 has a cylinder port 36 positioned to allow a fluid 37 to pass from a fluid conduit 38 into the actuator volume 20. This application uses hydraulic oil as the fluid 37. Other fluids such as fuel may also be used. A by-pass conduit 40 connects between a by-pass port 42 positioned along the brake actuator cylinder 14 and a return port 44 positioned along the brake actuator cylinder 14 in fluid communication with said second actuator volume 22. In this embodiment, the fluid conduit 38 connects to a master cylinder 46. A master piston 48 is slidably positioned in the master cylinder 46. A cam 50 connects mechanically with the master piston 48. In this application, the cam 50 is designed to actuate a fuel injector 52 in a conventional manner.

While in a first position P1, the brake actuator piston 12 blocks the by-pass port 42. While the brake actuator piston 12 is in a second position P2, the by-pass conduit 40 connects the first actuator volume 20 with the second actuator volume 22 through the by-pass port 42 and return port 44 respectively.

Figure 2:
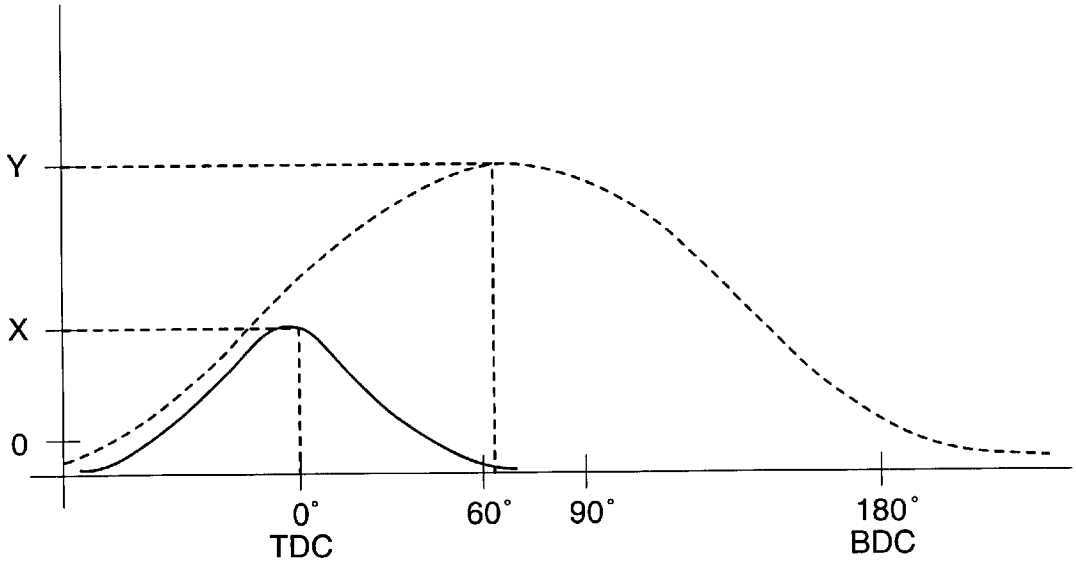
FIG. 2 shows a graph of displacement of an exhaust valve and fuel injector in relation to an engine crank angle for the present invention.

Operating off the cam 50 designed to actuate the fuel injector 52, FIG. 2 shows the exhaust valve 26 reaching some predetermined full travel length X ahead of the full travel length Y of the fuel injector 52. Optimizing braking performance requires the exhaust valve 26 to reach its full travel length X as the piston 32 approaches TDC. Further, the piston 32 should return to a closed range O as quickly as possible, but at least by a crank angle of about sixty degrees after TDC. In contrast, the full travel length Y may not come until about sixty degrees after TDC.

Industrial Applicability

The compression brake system 10 improves braking performance without added complexity involved in electronic actuation and valving. Instead, the brake actuator piston 12 cooperates with the by-pass port 42 to use hydraulic forces generated by the cam 50 to move the exhaust valve 26 from position O to X and back instead of relying on spring forces to return the valve 26 from X back to O.

As the cam 50 rotates to operate the fuel injector 52, the master piston 48 begins building hydraulic pressure in the master cylinder 46. During braking, a by-pass valve (not shown) in the fuel injector allows the fluid 37 to by-pass the fuel injector 52. Instead, the fluid 37 accumulates in the first actuating volume 20 driving the brake actuator piston 12 into engagement with the valve 26. Through proper design, the valve 26 will reach its full travel length X as the piston 32 reaches TDC.

Opening the valve 26 at TDC allows the piston 32 to expend maximum energy compressing gases in the combustion cylinder 34 prior to expending it through the valve 26. The by-pass port 42 is positioned to begin passing fluid into the second actuator volume 22 near TDC. Fluid in second actuator volume 22 coupled with spring forces will return the valve 26 to position O at around sixty degrees after TDC or sooner. By returning the valve 26 early, the piston 32 may act against a vacuum in the combustion cylinder further retarding the engine 30.

Other aspects, objects, and advantages of this invention can be obtained from a study of the drawings, the disclosure, and the appended claims.

LIST OF ELEMENTS

TITLE: Compression Brake System for an Internal Combustion Engine
FILE: 00-474

10 compression brake system
12 brake actuator piston
14 brake actuator cylinder
16 first actuating surface
18 second actuating surface
20 first actuator volume
22 second actuator volume
24 seal
26 valve
28 port
30 internal combustion engine
31 valve spring
32 piston
34 combustion cylinder
36 cylinder port
37 fluid
38 fluid conduit
40 by-pass conduit
42 by-pass port
44 return port
46 master cylinder
48 master piston
50 cam
52 fuel injector

What is claimed is:

1. A compression brake system (10) for an internal combustion engine (30), said compression brake system (10) comprising:

a master cylinder (46);

a master piston (48) slidably positioned in said master cylinder;

a brake actuator cylinder (14) being fluidly connected with said master cylinder (46); and a brake actuator piston (12) slidably positioned in said brake actuator cylinder (14), said brake actuator piston (12) being adapted to actuate a valve (26), said brake actuator piston (12) having a first actuating surface (16) and a second actuating surface (18), said first actuating surface (16) and said brake actuator cylinder (14) defining a first actuator volume 20, said second actuating surface (18) and said brake actuator cylinder (14) defining a second actuator volume (22), said brake actuator piston (12) having a first position, said first position limiting fluid communication between said master cylinder and said second actuating volume (22), said brake actuator piston (12) having a second position, said second position allowing fluid communication between said master cylinder (46) and said second actuator volume (22), and said brake actuator piston (12) movable through a range between said first position and said second position, and wherein said brake actuator piston (12) is near said first position when a corresponding piston (32) of said internal combustion engine (30) is near sixty degrees after top dead center.

2. The compression brake system (10) as defined in claim 1 further comprising a by-pass port (42) being adjacent said first actuator volume (20) and a return port (44) being adjacent said second actuator volume (22), said by-pass port (42) and said return port (44) being connected by a by-pass conduit (40).

3. The compression brake system (10) as defined in claim 2 wherein said brake actuator piston (12) limits fluid communication between said first actuator volume (20) and said second actuator volume (22) in said first position.

4. The compression brake system (10) as defined in claim 1 wherein said brake actuator piston (12) is near said second position when a corresponding piston (32) in an internal combustion engine (30) is near top dead center.

5. The compression brake system (10) as defined in claim 1 further comprising a cam (50) connected with said master piston (48).

6. The compression brake system (10) as defined in claim 5, wherein said cam (50) being adapted to operate a fuel injector (52).

7. A compression brake actuator for an internal combustion engine (30), said compression brake actuator comprising:

a brake actuator cylinder (14) being connectable with a fluid conduit (38);

a brake actuator piston (12) slidably positioned in said brake actuator cylinder (14), said brake actuator piston (12) having a first actuating surface (16) and a second actuating surface (18);

a first actuator volume (20) being defined by said first actuating surface (16) and said brake actuator cylinder (14);

a second actuator volume (22) being defined by said second actuating surface (18) and said brake actuator cylinder (14);

said brake actuator piston (12) having a first position, said first position limiting fluid communication between said fluid conduit (38) and said second actuating volume (22), said brake actuator piston (12) having a second position, said second position allowing fluid communication between said fluid conduit (38) and said second actuator volume (22), said brake actuator piston (12) movable through a range between said first position and said, second position, and wherein said brake actuator piston (12) is near said first position when a corresponding piston (32) of said internal combustion engine (30) is near sixty degrees after top dead center.

8. The compression brake actuator as defined in claim 7 further comprising a by-pass port (42) being adjacent said first actuator volume (20) and a return port (44) being adjacent said second actuator volume (22), said by-pass port (42) and said return port (44) being connected by a by-pass conduit (40).

9. The compression brake system (10) as defined in claim 8 wherein said brake actuator piston (12) limits fluid communication between said first actuator volume (20) and said second actuator volume (22) in said first position.

10. A compression brake system (10) for an internal combustion engine (30), said compression brake system (10) comprising:

a master cylinder (46);

a master piston (48) slidably positioned in said master cylinder;

a brake actuator cylinder (14) being fluidly connected with said master cylinder (46);

a brake actuator piston (12) slidably positioned in said brake actuator cylinder (14), said a brake actuator piston (12) being adapted to actuate a valve (26), said brake actuator piston (12) having a first actuating surface (16) and a second actuating surface (18), said first actuating surface (16) and said brake actuator cylinder (14) defining a first actuator volume 20, said second actuating surface (18) and said brake actuator cylinder (14) defining a second actuator volume (22), said brake actuator piston (12) having a first position, said first position limiting fluid communication between said master cylinder and said second actuating volume (22), said brake actuator piston (12) having a second position, said second position allowing fluid communication between said master cylinder (46) and said second actuator volume (22), said brake actuator piston (12) movable through a range between said first position and said second position, and a by-pass port (42) being adjacent said second actuator volume (22), said by-pass port (42) and said return port (44) being connected by a by-pass conduit (40), said by-pass conduit being free from other fluid connections.

11. The compression brake system (10) as defined in claim 10 wherein said brake actuator piston (12) limits fluid communication between said first actuator volume (20) and said second actuator volume (22) in said first position.

12. The compression brake system (10) as defined in claim 11 wherein said brake actuator piston (12) is near said second position when a corresponding piston (32) in an internal combustion engine (30) is near top dead center.

13. The compression brake system (10) as defined in claim 12 wherein said brake actuator piston (12) is near said first position when a corresponding piston (32) in an internal combustion engine (30) is near sixty degrees after top dead center.

* * * * *